US005101563A

United States Patent [19]

d'Orgelys

[11] Patent Number: 5,101,563

[45] Date of Patent: Apr. 7, 1992

[54] NAIL CLIPPER

[76] Inventor: Henri d'Orgelys, 3936 San Clerc Rd., Jacksonville, Fla. 32217

[21] Appl. No.: 622,525

[22] Filed: Dec. 5, 1990

[51] Int. Cl.[5] ..... A45D 29/02; A45D 29/04; B26B 13/16; B26B 13/00

[52] U.S. Cl. ..... 30/28; 30/29; 30/262; 7/158

[58] Field of Search ..... 30/26, 27, 28, 175, 30/113.1, 29; 7/119, 125, 158, 165, 167

[56] References Cited

U.S. PATENT DOCUMENTS

| | | | |
|---|---|---|---|
| 147,416 | 9/1847 | O'Brien . | |
| 188,590 | 3/1877 | Coates . | |
| 327,065 | 9/1885 | Burton . | |
| 1,882,218 | 10/1932 | Harvey . | |
| 1,915,450 | 6/1933 | Schnefel | 30/29 |
| 1,976,067 | 10/1934 | Hanson | 30/29 |
| 2,028,558 | 1/1936 | Nietzel et al. | 30/28 |
| 2,146,132 | 2/1939 | Schott . | |
| 2,507,345 | 4/1950 | Meesook | 30/28 |
| 2,521,027 | 9/1950 | Sorensen | 30/28 |
| 3,430,340 | 3/1969 | Perles . | |
| 4,555,822 | 12/1985 | Miceli | 7/158 |
| 4,600,007 | 7/1986 | Cahodney et al. . | |

FOREIGN PATENT DOCUMENTS

| | | | |
|---|---|---|---|
| 8356 | 4/1898 | Fed. Rep. of Germany | 30/29 |

*Primary Examiner*—Douglas D. Watts
*Assistant Examiner*—Paul M. Heyrana, Sr.
*Attorney, Agent, or Firm*—Fleit, Jacobson, Cohn, Price, Holman & Stern

[57] ABSTRACT

A nail clipper is provided including a pair of crossed and pivotally connected levers defining handle ends and blade ends. A bowed spring is disposed between the handle ends and includes split sleeve portions engaged with and extending at least partially about and anchored relative to the handle ends against longitudinal displacement relative thereto and a locking sleeve is removably telescoped over the handle ends to releasably retain the latter against swinging movement away from each other. Further, the blade ends of the levers include opposing arcuate cutting edges abuttingly engaged with each other when the blade ends are in their closed positions and which, together, open laterally outwardly of the clipper in one direction along the axis of relative pivotal movement of levers. Finally, the cutting edges terminate short of the terminal ends of the free ends of the blade ends and the free blade ends diverge away from each other from the point of termination of the cutting edges adjacent the free ends of the blade ends.

13 Claims, 1 Drawing Sheet

FIG. 1
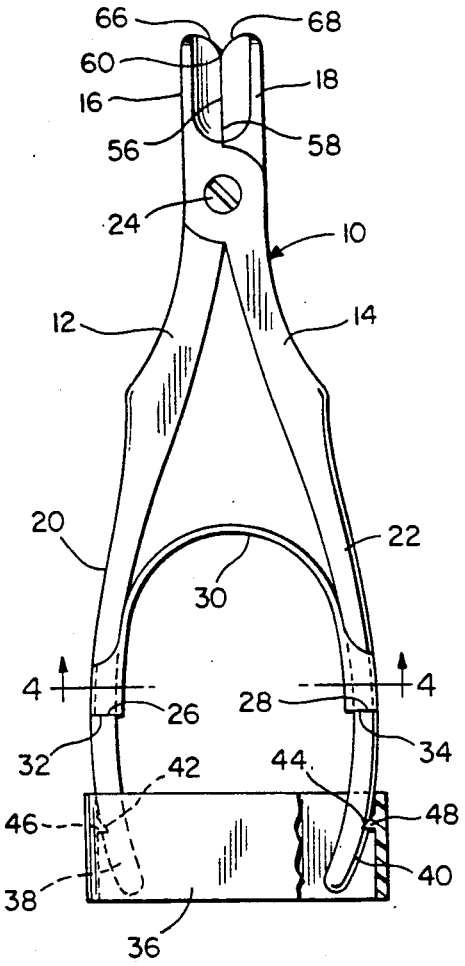
FIG. 2
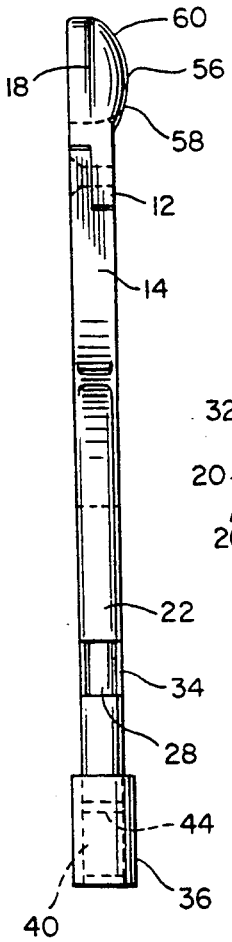
FIG. 3
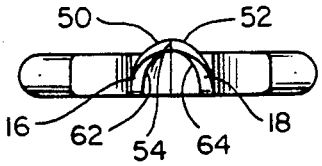
FIG. 4
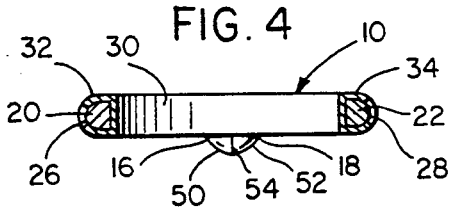
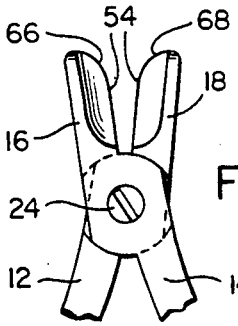
FIG. 5
FIG. 6
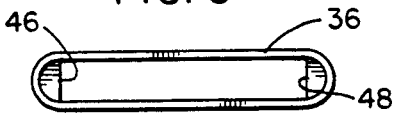
FIG. 7
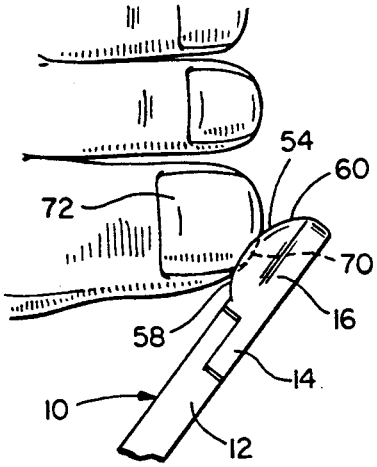
FIG. 8
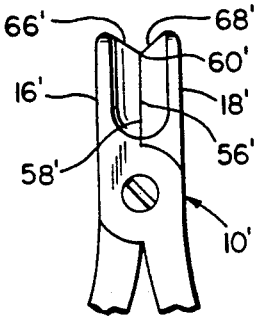
FIG. 9
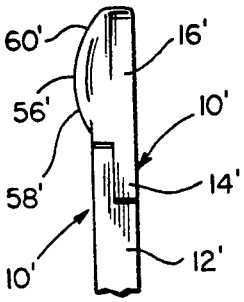

NAIL CLIPPER

BACKGROUND OF THE INVENTION

1. Field of the Invention

This invention relates to a nail clipper and more specifically to a toe nail clipper of the crossed and relatively pivoted levers-type including first opposing cutter jaw ends and second handle ends. A bowed spring is operatively connected between the handle ends of the levers so as to yieldingly bias the latter apart and a shape retentive but deformable locking sleeve is provided and coacts with grooves formed in the remote sides of the free ends of the handle ends for retaining the handle ends in their closest positions when the jaw ends of the levers are abuttingly engaged with each other. In addition, the jaw ends include coacting cutting edges between which to "nip" unwanted portions of toe nails away and the cutting edges are convexly curved and carried by opposing jaw ends whose terminal ends convexly curve away from each other in order to prevent a toe nail from being cut in a manner leaving sharp corners or excessively trimmed corners, which conditions can result in end grown toe nails.

2. Description of Related Art

Various different forms of toe nail cutters heretofore have been provided including some of the general structural and operational features of the instant invention. In addition, certain other forms of cutters heretofore have been provided with rounded points. Examples of these previously known forms of cutters are disclosed in U.S. Pat. Nos. 188,590, 327,065, 1,882,218, 2,146,132, 3,430,340, 4,600,007 and DES. 147,416. However, these previously known forms of cutters do not include the overall combination of structural and operational features of the instant invention.

SUMMARY OF THE INVENTION

The nail clippers of the instant invention include convexly curved cutting edges carried by the jaw ends of a pair of plier-type cutters and the cutting edges terminate at points spaced from the free terminal ends of the jaws, which free terminal ends convexly curve away from each other.

The main object of this invention is to provide a nail clipper specifically designed for use in cutting the toe nails and which is constructed in a manner that will substantially prevent persons using the clipper from clipping the corner portions of their nails too sharp or too short.

Another object of this invention is provide a nail clipper including a novel bow spring for yieldingly biasing the handle ends of the levers of the clipper apart.

Yet another object of this invention, in accordance with the immediately preceding object, is to provide the clipper with novel means for anchoring the free ends of the bow spring to the handle ends of the levers.

A further object of this invention is provide the clipper with a novel shape retentive but deformable sleeve which may be engaged over the free ends of the handle ends of the levers in order to prevent the handle ends from being displaced away from each other.

A final object of this invention to be specifically enumerated herein is to provide a nail clipper in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a top plan view of the nail clipper of the instant invention illustrated with a shape retentive, but deformable, locking sleeve applied to the terminal ends of the handle ends of the levers and with portions of the locking sleeve broken away and illustrated in section;

FIG. 2 is a right side elevational view of the assemblage illustrated in FIG. 1;

FIG. 3 is a front elevational view of the clipper illustrated with the upper side thereof lowermost;

FIG. 4 is a vertical sectional view taken substantially upon the plane indicated by the section line 4—4 of FIG. 1;

FIG. 5 is a fragmentary top plan view of the clipper illustrating the jaw end thereof with the jaws in an open position;

FIG. 6 is an end elevational view of the locking sleeve;

FIG. 7 is a fragmentary elevational view of a foot with the clipper fragmentarily illustrated in position to cut a portion of a toe nail of the foot;

FIG. 8 is a fragmentary top plan view of the jaw end of a modified from of nail clipper; and FIG. 9 is a fragmentary left side elevational view of the modified from of nail clipper.

DESCRIPTION OF THE PREFERRED EMBODIMENTS

Referring now more specifically to FIGS. 1–7 of the drawings, a first form of nail clipper constructed in accordance with the present invention is referred to in general by the reference numeral 10. The clipper 10 includes a pair of crossed and pivotally connected levers 12 and 14 including opposing jaw ends 16 and 18 and opposing handle ends 20 and 22. The levers 12 and 14 are pivotally connected through the utilization of a conventional form of pivot fastener 24 and the handle ends 20 and 22 are bowed and open toward each other. In addition, longitudinal mid-portions of the handle ends 20 and 22 are provided with peripherally extending anchor grooves 26 and 28 which extend substantially fully about the remote sides of the handle ends 20 and 22.

A bowed leaf spring 30 is provided and its opposite ends include integral split sleeves 32 and 34 seated in the grooves 26 and 28 in a manner to prevent shifting of the sleeves 32 and 34 longitudinally of the handle ends 20 and 22. The resiliency of the bowed spring 30 yieldingly biases the handle ends 20 and 22 away from each other. However, in FIGS. 1 and 2 of the drawings, a plastic or other similar material locking sleeve 36 is engaged over the terminal ends 38 and 40 of the handles ends 20 and 22 and maintains the handles ends 20 and 22 in their closest "closed" positions. The remote sides of the terminal ends 38 and 40 include notches 42 and 44 formed therein and the sleeve 36 includes tangs 46 and 48 which are removably seated in the grooves 42 and 44. The locking sleeve 36 is shape retentive, but at least somewhat deformable and stretchable so as to be readily slipped over the convergent terminal ends 38 and 40 into position with the tangs 46 and 48 snap-engaged in the grooves 42 and 44.

The jaw ends 16 and 18 include convex radiused under surfaces 50 and 52 which abut each other in sharpened edges as at 54. In addition the under surfaces are longitudinally convexly curved as at 56 and the sharpened edges 54 extend from point 58 to point 60, only, as indicated in FIGS. 1 and 2 and along a plane generally paralleling the axis of relative oscillation of the levers 12 and 14 defined by the pivot fastener 24. The upper inner surfaces of the jaw ends 16 and 18 are cupped as at 62 and 64 and the free terminal ends of the jaw ends 16 and 18 are convexly curved away from each other and the aformentioned plane as at 66 and 68.

Referring now more specifically to FIG. 7, it may be seen that the clipper 10, when used to cut one corner portion 70 of toe nail 72, cannot cut the corner portion too short or too sharp. This is because the curvature of the sharpened edges 54 is opposite to the curvature of the edge of the toe nail 72 and the same would be true even if the corner portion 70 of the toe nail 72 were being cut by the clipper 10 with the latter being held in the left hand of the user.

With reference now more specifically to FIGS. 8 and 9, a modified form of toe nail clipper is referred to in general by the reference numeral 10'. The toe nail clipper 10' is substantially identical in construction to the toe nail clipper 10, except that the free end edges of the jaws 16' and 18' do not curve away from each other from point 60' corresponding to point 60, but rather diverge away from each other along straight paths as at 66' and 68', the sharpened edges 56' corresponding to the sharpened edges 56 extending from point 60' to point 58'.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A tool including a pair of crossed and pivotally connected levers having opposing jaw ends and opposing handle ends simultaneously swingable toward and away from each other between open position with said jaw and handle ends displaced away from each other and closed positions with said jaw ends contacting each other and said handle ends displaced toward each other and disposed in laterally spaced part relation, an elongated arcuate spring disposed between said handle ends and including a central blade portion and terminal ends opposing longitudinal mid-portions of the adjacent sides of said handle ends, said terminal ends including integral split sleeves, said longitudinal mid-portions of said handle ends including recess means in which at least portions of said split sleeves are retentively seated.

2. The tool of claim 1 wherein said recess means includes an anchor groove extending at least partially about each of said longitudinal mid-portions of said handles ends in which said split sleeves are seated.

3. The tool of claim 2 including an locking sleeve removable telescoped over the free ends of said handle ends releasably retaining said handle ends in said closed positions.

4. The tool of claim 3 wherein remote ends of said handle ends including oppositely outwardly opening recess means formed therein, said locking sleeve being formed of shape retentive, but yieldable material and including portions thereof releasably seated in said recess means.

5. The tool of claim 4 wherein said recess means comprise transverse outwardly opening notches formed in said remote sides of said handle ends, said portions of said locking sleeve comprising yieldable tangs formed integrally with said locking sleeve and projecting inwardly of the interior thereof.

6. The tool of claim 1 wherein said jaw ends comprise cutting blade ends defining opposing one-half cupped-shaped jaws abuttingly engaged with the other when said blade ends are in said closed positions and which are abuttingly engaged with each other along arcuate opposing cutting edges, the ends of said cutting edges adjacent the free ends of said blade ends terminating a spaced distance from said free ends, the free ends of said blade ends diverging away from each other from the ends of said cutting edges adjacent said free ends.

7. The tool of claim 6 wherein the remote ends of said handle ends including oppositely outwardly opening recess means formed therein, said locking sleeve being formed of shape retentive, but yieldable material and including portions thereof releasably seated in said recess means.

8. The tool of claim 7 wherein said recess means comprise transverse outwardly opening notches formed in said remote sides of said handle ends, said portions of said locking sleeve comprising yieldable tangs formed integrally with said locking sleeve and projecting inwardly of the interior thereof.

9. A nail clipper including a pair of crossed and pivotally connected levers having opposing jaw ends and opposing handle ends simultaneously swingable toward and away from each other between open positions with said jaw and handle ends displaced away from each other and closed positions with said blade ends contacting each other and said handle ends displaced toward each other and disposed in laterally spaced apart relation, in locking sleeve removably telescoped over the free ends of said handle ends releasably retaining said handle ends in said closed positions. The remote ends of said handle ends including oppositely outwardly opening recess means formed therein, said locking sleeve being formed of shape retentive, but yieldable material and including portions thereof releasably seated in said recess means.

10. The nail clipper of claim 9 wherein said recess means comprise transverse outwardly opening notches formed in said remote sides of said handle ends, said portions of said locking sleeve comprising yieldable tangs formed integrally with said locking sleeve and projecting inwardly of the interior thereof.

11. A nail clipper including a pair of crossed and pivotally connected levers having opposing blade ends and opposing handle ends simultaneously swingable toward and away from each other about an axis disposed transverse to said levers between open positions with said blade and handle ends displaced away from each other and closed positions with said blade ends contacting each other and said handle ends displaced toward each other and disposed in laterally spaced apart relation, said blade ends including opposing one half cupped-shaped jaws abuttingly engaged with each other when said blade ends are in said closed positions and which are abuttingly engaged with each other along arcuate opposing cutting edges disposed in a plane generally paralleling said axes, the ends of said cutting edges adjacent the free ends of said blade ends terminating a spaced distance from said free ends, the free ends of said blade ends diverging away from said plane from the ends of said cutting edges adjacent said free ends.

12. The nail clipper of claim 11 wherein said divergent free ends of said blade ends curve away from each other.

13. The nail clipper of claim 11 wherein said free ends of said blade ends diverge away from each other along substantially straight paths.

* * * * *